United States Patent [19]

Legg

[11] 4,273,648

[45] Jun. 16, 1981

[54] QUICK MINER'S PAN

[76] Inventor: Robert E. Legg, 39463 Royal Palm Dr., Fremont, Calif. 95438

[21] Appl. No.: 129,085

[22] Filed: Mar. 10, 1980

[51] Int. Cl.[3] ..... B03B 5/02

[52] U.S. Cl. ..... 209/447; 209/458; 209/506

[58] Field of Search ..... 209/445–450, 209/443, 458, 422, 437, 506

[56] References Cited

U.S. PATENT DOCUMENTS

| | | | |
|---|---|---|---|
| 159,113 | 1/1875 | Oakes | 209/458 X |
| 845,395 | 2/1907 | Christmann | 209/446 |
| 1,704,265 | 3/1929 | Stephan | 209/443 |
| 2,178,390 | 10/1939 | Boekel | 209/447 |
| 2,355,375 | 8/1944 | Herbert | 209/506 X |
| 3,899,418 | 8/1975 | Lawrence et al. | 209/447 |

*Primary Examiner*—Ralph J. Hill
*Attorney, Agent, or Firm*—Robert Charles Hill

[57] ABSTRACT

A pan for separating gold or other precious heavy metals from wet sand or gravel is provided with a round bottom joined to obliquely rising sides at the circumference. Near the center of the bottom of the pan is an aperture leading to a trough which is formed integrally with the bottom and slopes downwardly therefrom. Within the trough is a ladder-like structure having a plurality of steps which collect the heavy metal particles from the dross.

4 Claims, 5 Drawing Figures

FIGURE 1
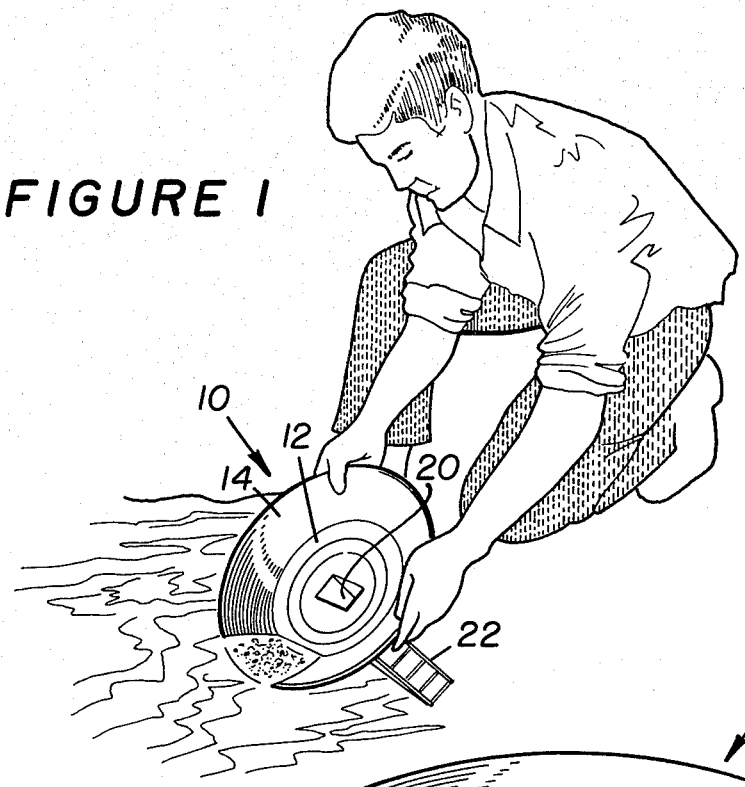
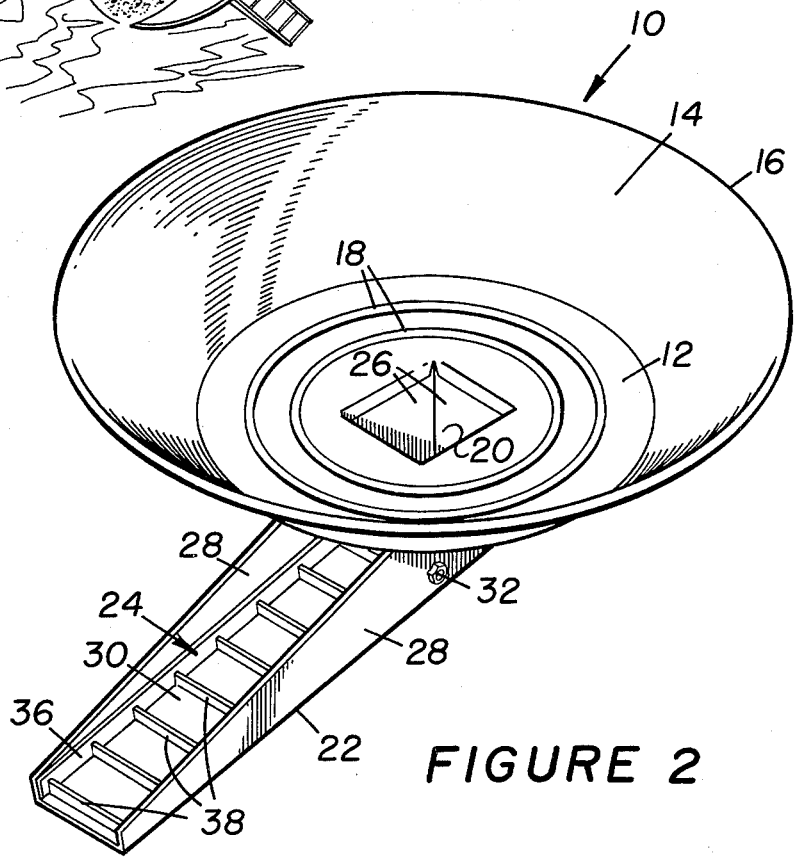
FIGURE 2

FIGURE 3
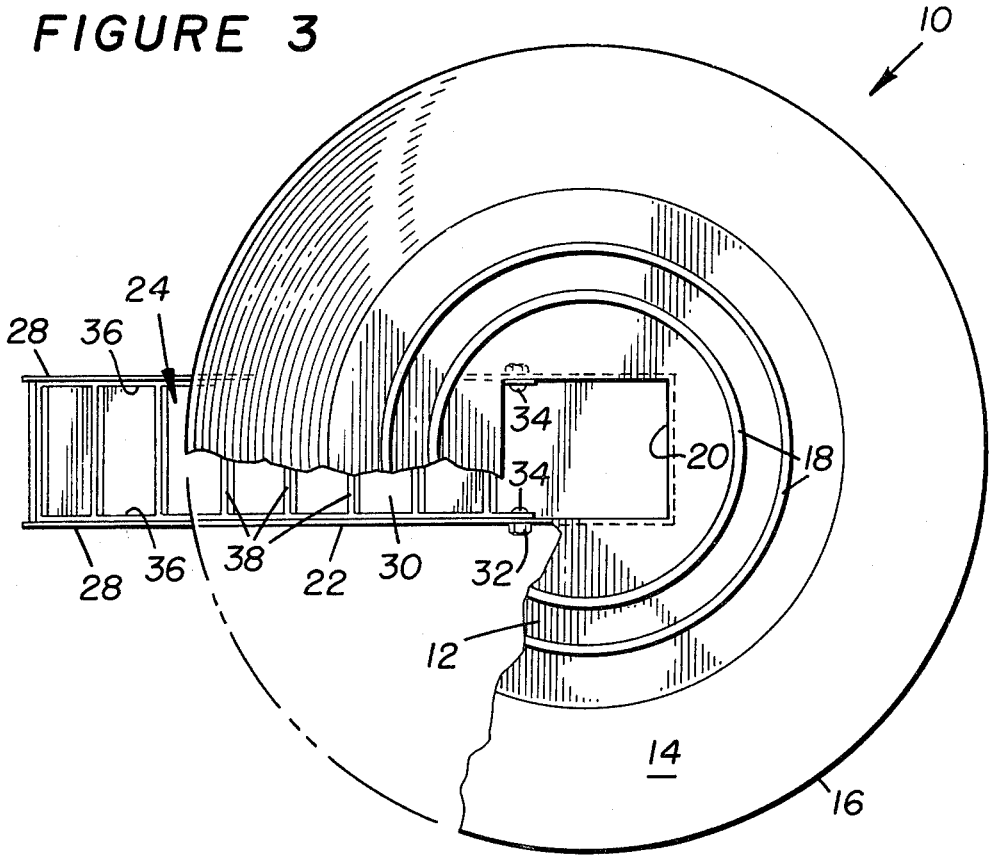
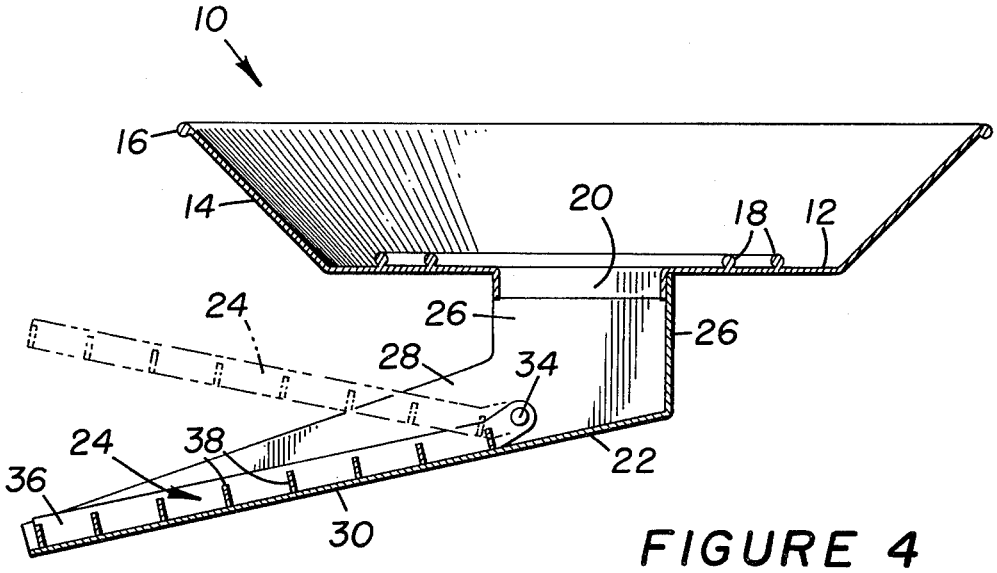
FIGURE 4

QUICK MINER'S PAN

BACKGROUND OF THE INVENTION

The following patents are the prior art closest to the present invention known to the inventor:

U.S. Pat. No. 185,116—Mann
U.S. Pat. No. 419,908—Bagley
U.S. Pat. No. 1,966,359—Ryan
U.S. Pat. No. 3,899,418—Lawrence All of the enumerated patents disclose structures for separating heavy precious metals such as gold from an aqueous placer material. Mann and Bagley disclose mining riffles for arresting and retaining particles of gold, amalgam, quicksilver and the like. The Mann and Bagley devices, however, are bulky and awkward and do not readily lend themselves to pan mining ordinarily done by one person. The Ryan pan employs a plurality of riffles in the rim structure. The miner's pan of Lawrence includes a mineral trap depending from the center of the bottom of the pan as well as a separating groove. These patents do not teach the use of a trough in association with a pan, the trough having therein a ladder-like structure. The prior art merely teaches minor improvements in retrieving precious metals from a placer material, but does not indicate any means whereby one prospector can increase the rate of separation of heavy metal from residue while simultaneously trapping the metal particles.

SUMMARY OF THE INVENTION

The quick miner's pan of the present invention is formed of oblique sides rising from the circumference of round bottom. Fabricated of a suitable metal, alloy or plastic material, the pan has associated therewith a trough to hasten precipitation of the heavy particles, combined with a ladder-like structure within the trough to retain the separated particles and prevent their loss. The trough may be attached to an existing pan. Preferably, however, the pan has an aperture leading to the trough which extends downwardly therefrom. In either case, a ladder-like structure having at least one rung or step is positioned within the trough and may be pivoted thereto at a point near the pan to assist in easy collection of the separated heavy metal particles.

It is the primary object of the present invention to provide a new and improved quick miner's pan.

Another object is to provide a device which will allow one person to efficiently pan a greater amount of placer material than has heretofore been possible.

A further object of the invention is to provide structure of the character described which is economical to produce and long lasting in usage.

BRIEF DESCRIPTION OF THE DRAWINGS

FIG. 1 is a depiction of the present invention in use.

FIG. 2 is a perspective view of the quick miner's pan of the present invention.

FIG. 3 is a top view of the present invention partially broken away.

FIG. 4 is a cross-sectional view taken substantially as indicated along line 3—3 of FIG. 3 with the ladder-like structure shown in dotted lines in a raised position.

DESCRIPTION OF THE PREFERRED EMBODIMENT

Figure 5:
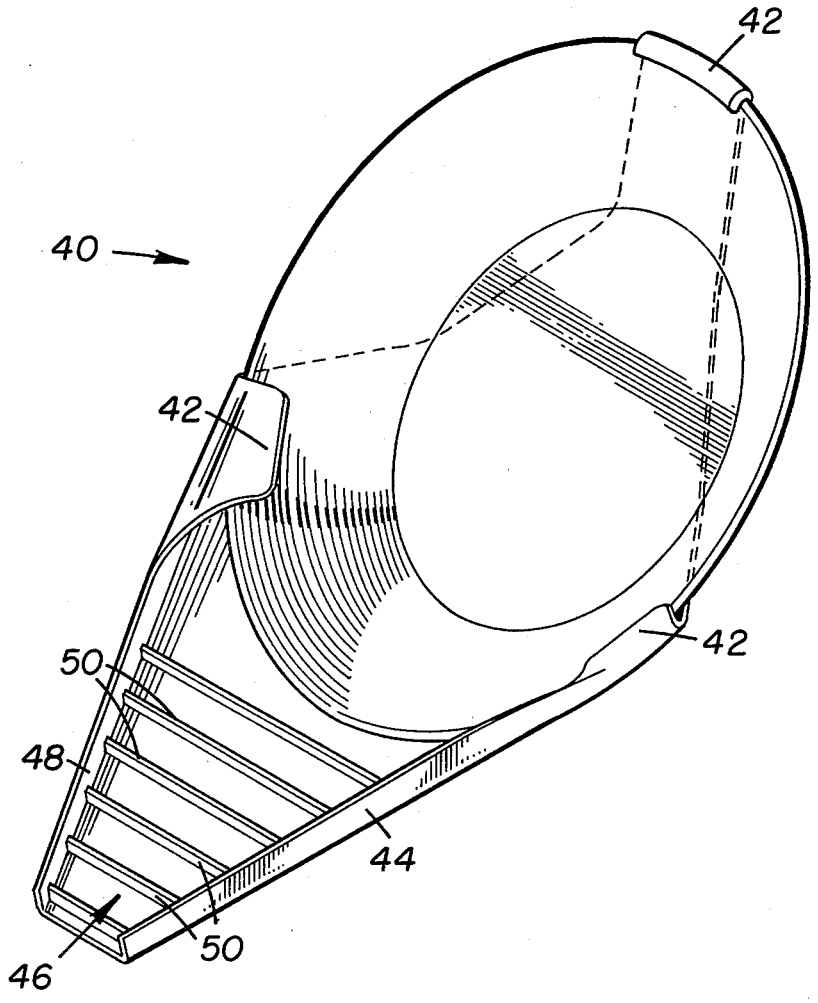
FIG. 5 is a perspective view of another form of the present invention.

Referring to FIGS. 1 through 4 of the drawings, there is shown the quick miner's pan of this invention, generally indicated 10, which is adaptable for use in separating heavy precious metals such as gold from a placer material such as sand and/or gravel. The quick miner's pan has a circular bottom 12 to which an obliquely rising side 14 with a lip 16 is integrally formed. The bottom 12 may be provided with a plurality of circular ribs 18 to assist in the separation.

Located centrally in the bottom 12 is aperture 20 of any desired shape which leads to trough 22 having therein a ladder-like structure 24. Trough 22 depends from the underside of bottom 12 by wall members 26 and slopes downward from the pan 10 and extends beyond lip 16. The trough 22 includes sides 28 which may be tapered down from below the aperture 20 to the end of the trough 2 and join base 30. The sides 28 and base 30 terminate in an open ended manner as best shown in FIG. 2.

The ladder-like structure 24 which may be pivotally connected to trough 22 by suitable means such as nuts 32 and bolts 34 and may be raised from the base of the trough 22 as shown in FIG. 4 includes sides 36 and a plurality of rungs or steps 38. As shown in FIG. 4, the sides 36 of the ladder-like structure 24 are adjacent the sides 28 of the trough 22 to prevent any heavy precious metals from travelling down the trough 24 without being stopped by a rung 38.

A variation of the present invention is shown in FIG. 5 wherein a conventional miner's pan, generally indicated 40, has removably attached thereto by clamps 42 an open-ended trough 44 having therein a ladder-like structure, generally indicated 46, having sides 48 and rungs or steps 50.

The entire pan, trough and ladder-like structure of the present invention may be integrally formed of clear transparent plastic material by vacuum molding or the like. Any transparent construction material may aid the miner in determining the progress of the panning operation and ascertaining the amount of heavy precious metals retrieved. Also, the plastic is light and resilient, and may be fabricated easily and economically.

In actual operation, the quick miner's pan 10 is submerged in a body of water such as a stream or creek and filled with water, sand and/or gravel containing heavy metal particles such as gold nuggets and flakes. The pan is lifted out of the water and the contents are directed to the trough, either through aperture 20 or over the side in FIG. 5, which trough should be directed away from the miner so the operator will not get wet. The water rushing down and out the trough carries the sand and gravel and any gold nuggets and flakes are collected by the steps in the ladder-like structure. The ladder is then raised above the trough and the precious metal particles are poured down the trough into a suitable container.

The downward angle of the trough 22 should be at least 10° and not more than 45° since the water flow cannot be so great that the precious particles do not have an opportunity to collect in the steps 34. Experimentation has shown that an angle of from 15° to 30° is satisfactory.

Thus, it can be seen that the present invention is much more efficient than previous structures in that there is no requirement for shaking of the pan or any other painstaking step prior to removal of the gold particles.

The foregoing description, as setting forth various constructional and operational details for purposes of understanding only, is not to be taken as limiting the scope of the present invention which is defined only by the following claims.

I claim:

1. A device for separating heavy precious metals from a placer material comprising:

a pan having a generally circular bottom and an upwardly and outwardly extending side wall formed integrally therewith, a centrally located aperture leading to a trough formed integrally with said pan, said trough sloping downwardly from the pan at least 10° and not more than 45°, and a ladder-like structure within said trough for retrieving said precious metals from said placer material.

2. The device of claim 1 wherein the trough slopes downwardly from the pan at least 15° and not more than 30°.

3. The device of claim 1 wherein the sides of the trough taper down from below the aperture to the end thereof.

4. The device of claim 1 wherein the trough extends past the pan.

* * * * *